US007014130B2

(12) United States Patent
Maier et al.

(10) Patent No.: US 7,014,130 B2
(45) Date of Patent: Mar. 21, 2006

(54) HIGH-PRESSURE FUEL DEVICE

(75) Inventors: Sieghart Maier, Gerlingen (DE); Siegfried Ruthardt, Altdorf (DE); Klaus Wuerth, Waldachtal (DE); Thomas Pauer, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 10/363,891

(22) PCT Filed: Mar. 27, 2002

(86) PCT No.: PCT/DE02/01111

§ 371 (c)(1),
(2), (4) Date: Sep. 22, 2003

(87) PCT Pub. No.: WO03/004866

PCT Pub. Date: Jan. 16, 2003

(65) Prior Publication Data

US 2004/0069279 A1 Apr. 15, 2004

(30) Foreign Application Priority Data

Jul. 7, 2001 (DE) ..... 101 33 167

(51) Int. Cl.
*F02M 59/00* (2006.01)
*F02M 47/02* (2006.01)
*B05B 1/30* (2006.01)

(52) U.S. Cl. ..... 239/533.2; 239/533.1; 239/585.1; 239/585.3; 239/585.5; 239/533.12; 239/88

(58) Field of Classification Search ..... 239/533.2, 239/533.1, 585.1–585.5, 533.7, 533.9, 88–93; 251/129.15, 129.21, 127
See application file for complete search history.

(56) References Cited

U.S. PATENT DOCUMENTS

| | | | | |
|---|---|---|---|---|
| 4,200,231 | A * | 4/1980 | Knape | 239/94 |
| 4,417,693 | A * | 11/1983 | Fussner et al. | 239/453 |
| 4,485,969 | A | 12/1984 | Deckard et al. | |
| 4,691,864 | A * | 9/1987 | Greeves | 239/453 |
| 5,443,209 | A | 8/1995 | Vanallsburg et al. | |
| 6,047,899 | A | 4/2000 | Graves | |

FOREIGN PATENT DOCUMENTS

| | | |
|---|---|---|
| DE | 19 739 905 | 3/1999 |
| EP | 0 334 364 | 9/1989 |
| EP | 0 799 991 | 10/1997 |

* cited by examiner

*Primary Examiner*—Davis Hwu
(74) *Attorney, Agent, or Firm*—Ronald E. Greigg

(57) ABSTRACT

A high-pressure fuel system including a housing having first and second high-pressure bodies (3, 5), which contact one another at a contact face. A high-pressure chamber in the housing passes through the contact face, and at least intermittently a high fuel pressure is present in the chamber (23). A wall part having a longitudinal axis surrounds the housing at least in the region of the contact face, so that a leak fuel chamber (32) is formed between the wall part and the housing which chamber is sealed off from the outside.

6 Claims, 3 Drawing Sheets

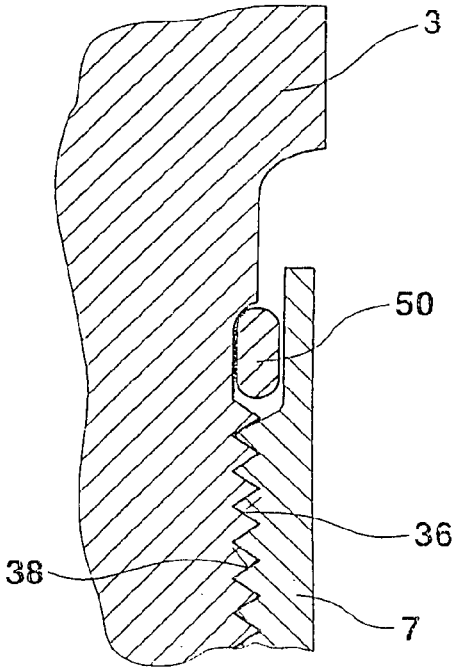
Fig. 2
Fig. 3
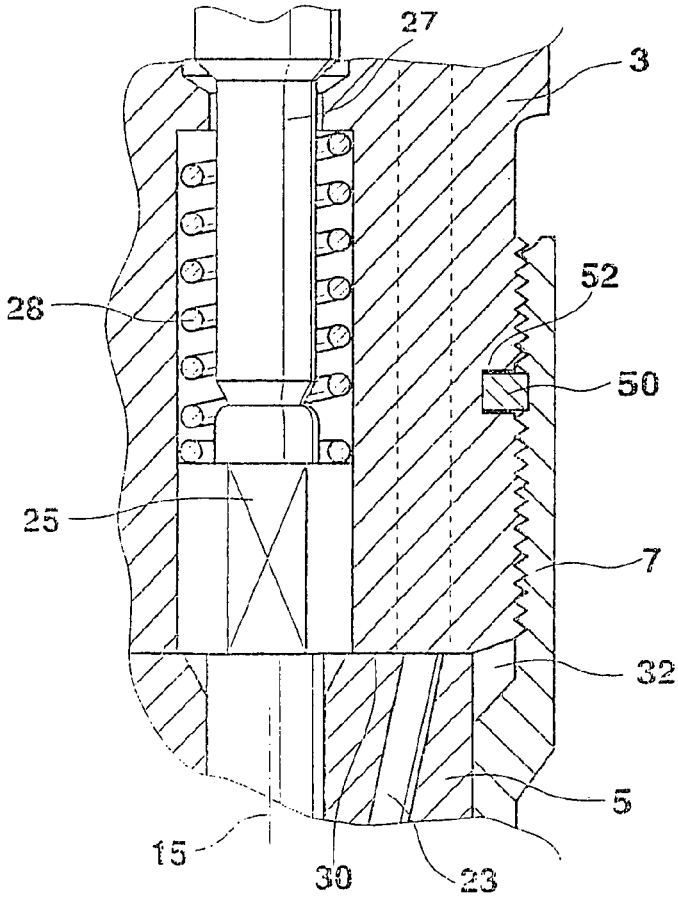

HIGH-PRESSURE FUEL DEVICE

CROSS-REFERENCE TO RELATED APPLICATIONS

This application is a 35 USC 371 application PCT/DE 02/01111 filed on Mar. 27, 2002.

BACKGROUND OF THE INVENTION

1. Field of the Invention

The invention is based on a high-pressure fuel system and is particularly suited for use in a fuel injection system of an internal combustion engine.

2. Description of the Prior Art

One high-pressure fuel system known in the form of a fuel injection valve from German Patent Disclosure DE 198 27 267 A1 and includes a housing, which contains a first high-pressure body, embodied as a valve holding body, and a second high-pressure body, embodied as a valve body. The two high-pressure bodies contact one another at a contact face. A high-pressure chamber in the form of a high-pressure conduit passes through the contact face and carries fuel at high pressure. The housing is surrounded in the region of the contact face by an essentially cylindrical wall part, which is embodied as a lock nut and has a longitudinal axis. Between the housing and the lock nut, a leak fuel chamber is formed, which surrounds the housing over its entire circumference.

In the known high-pressure fuel system, there is the drawback that leaks can occur in the region of the contact face. The high-pressure chamber is sealed off at its passage through the contact face only by the surface pressure of the bodies that contact one another at the contact face and surround the passage of the high-pressure chamber. Since in the high-pressure chamber, very high pressures of 120 MPa and more can sometimes prevail, this seal is not complete, so that an escape of fuel can occur at the contact face, which reaches the leak fuel chamber between the lock nut and the housing, and from there, over long-term operation of the high-pressure fuel system, it finally escapes. This can cause considerable damage in use in an internal combustion engine, especially if this fuel reaches the engine compartment, where hot parts set it on fire.

SUMMARY OF THE INVENTION

The high-pressure fuel system of the invention has the advantage over the prior art that even if leaks occur at the contact face of the two high-pressure bodies, no fuel can escape to the outside. For this purpose, the leak fuel chamber, formed between the housing and the wall part, is sealed off. The fuel that passes between the high-pressure bodies at the contact face and escapes thus remains in the leak fuel chamber, and the high-pressure fuel system is sealed off from the outside.

In an advantageous feature of the subject of the invention, a first sealing connection is embodied between the wall part and the first high-pressure body, and a second sealing connection is embodied between the wall part and the second high-pressure body. As a result, the leak fuel chamber is sealed off in a simple way, and the two sealing connections can be designed independently of one another.

In another advantageous feature of the subject of the invention, the leak fuel chamber communicates with a low-pressure chamber embodied in the housing, and a low fuel pressure is always maintained in the low-pressure chamber. Via this communication, the fuel can flow out of the leak fuel chamber, and a pressure backup over time, which could lead to leaks at the sealing connections, does not occur in the leak fuel chamber.

In another advantageous feature, the wall part is embodied as a lock nut, which presses the high-pressure bodies together at the contact face. In this way, the function of sealing off from the outside and the function of a lock nut for pressing the high-pressure bodies together are united in only a single component.

In another advantageous feature, one of the sealing connections of the wall part and the housing is formed by the contact of a sealing face, embodied on the wall part, and a contact face, embodied on the housing. In this feature, the contact pressure exerted by the lock nut can be utilized for one of the sealing connections, without requiring other sealing or clamping elements.

In another advantageous feature, at least one sealing connection of the wall part and the housing is formed by a sealing ring disposed between the housing and the wall part. As a result, good tightness can be achieved, and the sealing ring can be adapted to various given conditions.

In a further advantageous feature, the sealing ring is manufactured from an elastically deformable material, preferably a plastic or an elastomer. A sealing ring of this kind can adapt to the space between the wall part and the housing by deforming and as a result can provide secure sealing.

In a further advantageous feature, the sealing ring is made from polytetrafluoroethylene (PTFE), which besides good tightness offers the advantage that the sealing ring is extraordinarily resistant chemically and is not attacked by the fuel. Moreover, PTFE has high heat resistance and is thus especially well suited to use in fuel injection valves, which are exposed to high temperatures.

The high-pressure fuel system of the invention is especially advantageous if it is embodied as a fuel injection valve for an internal combustion engine, since the sealing problems that occur there cannot be conclusively solved by provisions made at the contact face. Still other advantages result as well: The demands in terms of quality of the sealing faces of the two high-pressure bodies are reduced markedly, since a certain leakage quantity outward into the leak fuel chamber is acceptable. Furthermore, there is the advantage that the high-pressure bodies have to be pressed against one another with lesser force, which leads to a reduction in the mechanical stresses in the fuel injection valve and thus to reduced deformation that could otherwise impair the function of the fuel injection valve.

BRIEF DESCRIPTION OF THE DRAWINGS

Further advantages and advantageous features of the invention can be learned from the description contained herein below, taken in conjunction with the drawings, in which:

FIG. 2 is an enlargement of the detail marked II in FIG. 1;

FIG. 3 is an enlargement of FIG. 1 in the area marked III; and

DESCRIPTION OF THE PREFERRED EMBODIMENTS

Figure 1:
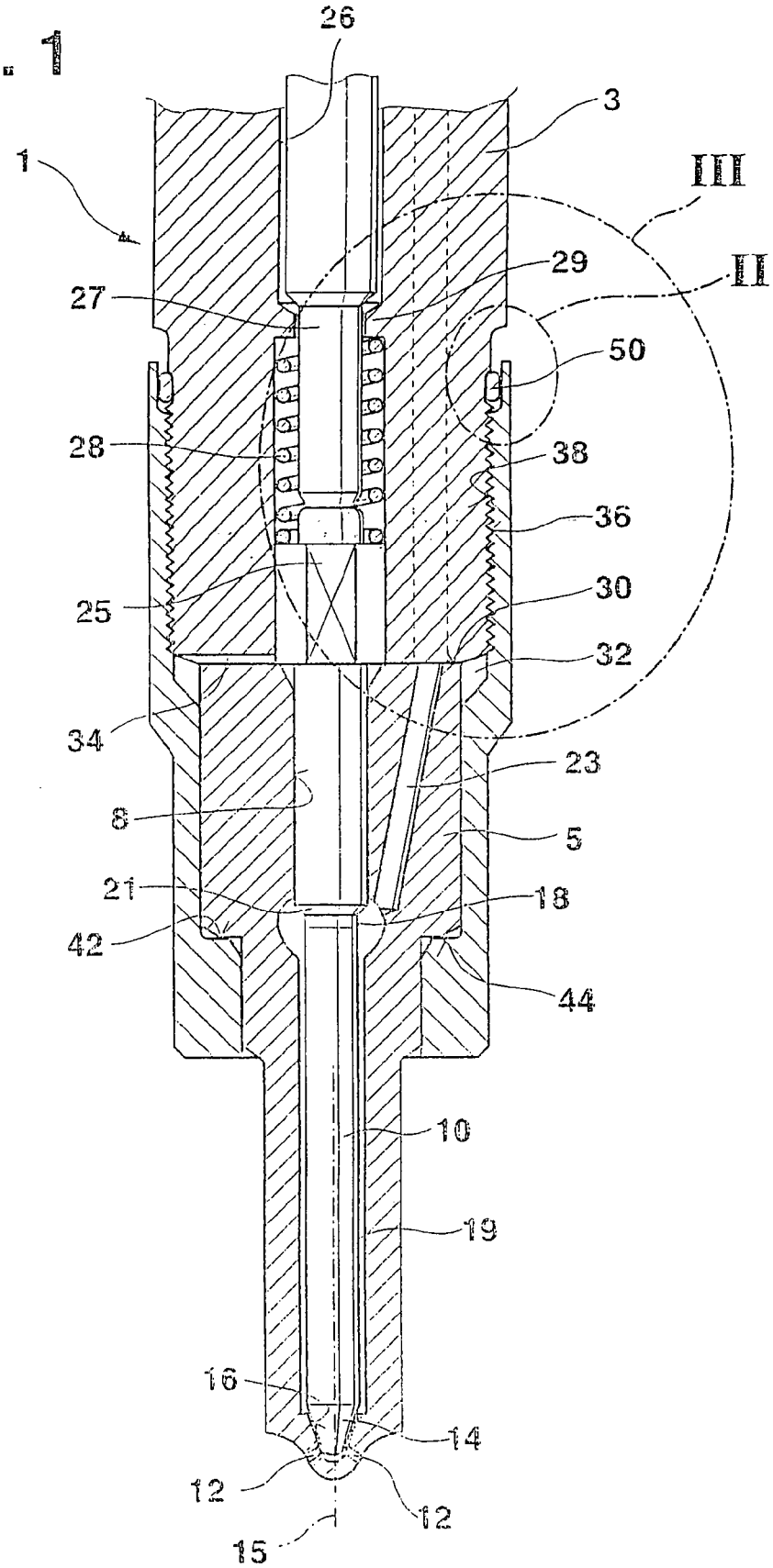
FIG. 1 shows a high-pressure fuel system of the invention in longitudinal section, in the form of a fuel injection valve.

In FIG. 1, one exemplary embodiment of the high-pressure fuel system of the invention is shown in longitudinal section with its essential parts. The high-pressure fuel system, embodied here as a fuel injection valve, has a housing 1, which includes a first high-pressure body, which is embodied as a valve holding body 3, and a second high-pressure body, which is embodied as a valve body 5. The valve holding body 3 rests on a contact face 30 on the valve body 5 and is pressed against it by means of a lock nut 7 embodied as a wall part. A bore 8 is embodied in the valve body 5 and has a longitudinal axis 15 that also coincides with the longitudinal axis 15 of the lock nut 7. A pistonlike valve needle 10 is disposed longitudinally displaceably in the bore 8; it is guided sealingly in a portion of the bore 8 remote from the combustion chamber, and toward the combustion chamber, it tapers, forming a pressure shoulder 21. On the end toward the combustion chamber, the valve needle 10 changes over into an essentially conical valve sealing face 14, which cooperates with a valve seat 16, embodied on the end of the bore 8 toward the combustion chamber, which is likewise shaped essentially conically and has approximately the same opening angle as the valve sealing face 14. A plurality of injection openings 12 are embodied in the valve seat 16, connecting the valve seat 16 with the combustion chamber of the engine. At the level of the pressure shoulder 21, a radial enlargement of the bore 8 forms a pressure chamber 18, which can be filled with fuel at high pressure via an inflow conduit 23 embodied in the valve body 5 and the valve holding body 3. The inflow conduit 23 forms a high-pressure chamber and passes through the contact face 30 of the two high-pressure bodies 3; 5. The pressure chamber 18 continues, toward the valve seat 16, in the form of an annular conduit 19 surrounding the valve needle 10, so that fuel can flow out of the pressure chamber 18 as far as the valve seat 16. Upon contact of the valve sealing face 14 with the valve seat 16, the injection openings 12 are closed, and no fuel from the annular conduit 19 reaches the injection openings 12. If the valve sealing face 14 lifts from the valve seat 16 as a result of a longitudinal motion of the valve needle 10, fuel then flows out of the annular conduit 19 through the gap, formed between the valve sealing face 14 and the valve seat 16, to the injection openings 12, and fuel is injected into the combustion chamber of the engine.

In the region where the valve needle 10 is guided, the valve body 5 is embodied with a cylindrical outer face, which is provided with a shoulder directed toward the combustion chamber approximately at the level of the pressure chamber 18, forming a contact face 44; the contact face 44 is located in a radial plane to the bore 8. The lock nut 7 is embodied essentially as a hollow cylinder, and it surrounds the valve body 5 and part of the valve holding body 3, especially in the region of the contact face 30. On its end toward the combustion chamber, the lock nut 7 has a collar, on which a sealing face 42 is formed, which comes to rest on the contact face 44 and forms a first sealing connection between the lock nut 7 and the housing 1. In the end region remote from the combustion chamber, the lock nut 7 has a female thread 38, which engages a male thread 36 embodied on the outer jacket face of the valve holding body 3. Rotating the lock nut 7 screws it to the valve holding body 3 and thus displaces it longitudinally, so that the sealing face 42 is pressed against the contact face 44, and the valve body 5 in the contact face 30 is pressed against the valve holding body 3.

Between the lock nut 7 on the one hand and the valve holding body 3 and the valve body 5, respectively, on the other, a leak fuel chamber 32 is formed, which is sealed off in the end region toward the combustion chamber by the contact of the sealing face 42 with the contact face 44. In the end region remote from the combustion chamber of the lock nut 7, the sealing is accomplished by a sealing ring 50, which is clamped between the lock nut 7 and the valve holding body 3 and thus forms a second sealing connection. FIG. 2, for purposes of clarity, shows an enlargement of the region marked II in FIG. 1, showing the sealing ring 50 in cross section. The sealing ring 50 is made from an elastic material, such as rubber or a plastic, so that it can deform accordingly and create a sealing connection of the lock nut 7 with the valve holding body 3. Especially polytetrafluoroethylene is advantageous here, because this plastic is largely chemically inert. The leak fuel chamber 32 is thus sealed off, and no fuel can reach the outside.

Remote from the combustion chamber, the bore 8 changes over into a piston bore 26, which is embodied in the valve holding body 3 and at the transition has a somewhat larger diameter than the bore 8. A thrust piece 25 is disposed in the piston bore 26 and rests on the end face, remote from the combustion chamber, of the valve needle 10. The thrust piece 25 is adjoined by a valve piston 27, which is likewise guided in the piston bore 26 and is disposed coaxially to the valve needle 10. The valve piston 27 can exert a closing force, via the thrust piece 25, on the valve needle 10, so that this valve needle is pressed by its valve sealing face 14 against the valve seat 16. Also disposed in the piston bore 26 is a closing spring 28, which remote from the valve needle 10 is braced on an annular shoulder 29 and with its other end is braced on the thrust piece 25. Since the closing spring 28 is compressively prestressed, it exerts a closing force on the valve needle 10, which tends to keep the valve needle in its closing position—especially when the engine is not running. The piston bore 26 communicates with a leak fuel system, not shown in the drawing, so that the piston bore 26 forms a low-pressure chamber, in which a low fuel pressure always prevails. Via the annular gap between the valve needle 10 and the wall of the bore 8, only very little fuel can flow out of the pressure chamber 18 into the piston bore 26, where it is then immediately carried away into the leak fuel system.

The motion of the valve needle 10 in the bore 8 and thus the control of the instant and duration of injection are effected in such a way that the closing force on the valve needle 10 is controlled. By means of a device not shown in the drawing, a force that is controllable is exerted on the end of the valve piston 27 remote from the combustion chamber. Via the inflow conduit 23, from a high-pressure source also not shown in the drawing, fuel is carried at high pressure into the pressure chamber 18, and for the entire duration of operation, a predetermined high pressure is maintained in the pressure chamber 18. The fuel pressure in the pressure chamber 18 and thus also in the annular conduit 19 thus exerts a hydraulic force on the pressure shoulder 21 and on parts of the valve sealing face 14, which force counteracts the closing force of the valve piston 27 and closing spring 28. If the closing force on valve needle 10 is reduced, then the hydraulic opening force predominates, and the valve needle 10 with its valve sealing face 14 lifts from the valve seat 16, so that fuel can flow to the injection openings 12. If the closing force is increased again to such an extent that it is higher than the opening force, the valve needle 10 is displaced in the direction of the valve seat 16 again, and the injection openings 12 are closed.

Because of the high fuel pressure that constantly prevails in the inflow conduit 23, very stringent demands are made in terms of tightness at the contact face of the two high-pressure bodies 3; 5, to minimize the escape of fuel from the inflow conduit 23 between the valve body 5 and the valve holding body 3. The portion of the fuel that does pass inward into the piston bore 26 is carried away from there into the leak fuel system, where it does not impede the operation of the fuel injection valve. Any fuel flowing from outward into the leak fuel chamber 32 is kept there, so that the fuel injection valve is tight from the outside. However, if more fuel flows into the leak fuel chamber 32, then a pressure cushion can build up there, which sooner or later will cause a leak either at the sealing ring 50 or at the sealing face 42. To prevent this, a connecting conduit 34 in the form of a groove is formed at the face end, toward the valve body 5, of the valve holding body 3, and connects the leak fuel chamber 32 with the piston bore 26. The fuel in the leak fuel chamber 32 can thus flow out, and the leak fuel chamber 32 remains pressureless.

FIG. 3 shows an enlargement of FIG. 1 in the detail marked III of a further exemplary embodiment. The sealing ring 50 here is not disposed on the end of the lock nut 7 but instead is located in an annular groove 52, which surrounds the valve holding body 3 over its entire circumference. The annular groove 52 is disposed in the male thread 36, so that in terms of the longitudinal axis 15, part of the male thread 36 is located on each side of the annular groove 52. The sealing ring 50 is disposed in the annular groove 52 before the lock nut 7 is screwed in, so that the lock nut 7 with the female thread 38 slips over the sealing ring 50 upon assembly. Since the sealing ring 50 comprises an elastic, readily deformable material, the lock nut deforms the sealing ring 50 and with its female thread 38 digs into the sealing ring 50. As a result, a very tight connection between the lock nut 7 and the sealing ring 50 is achieved.

Figure 4:
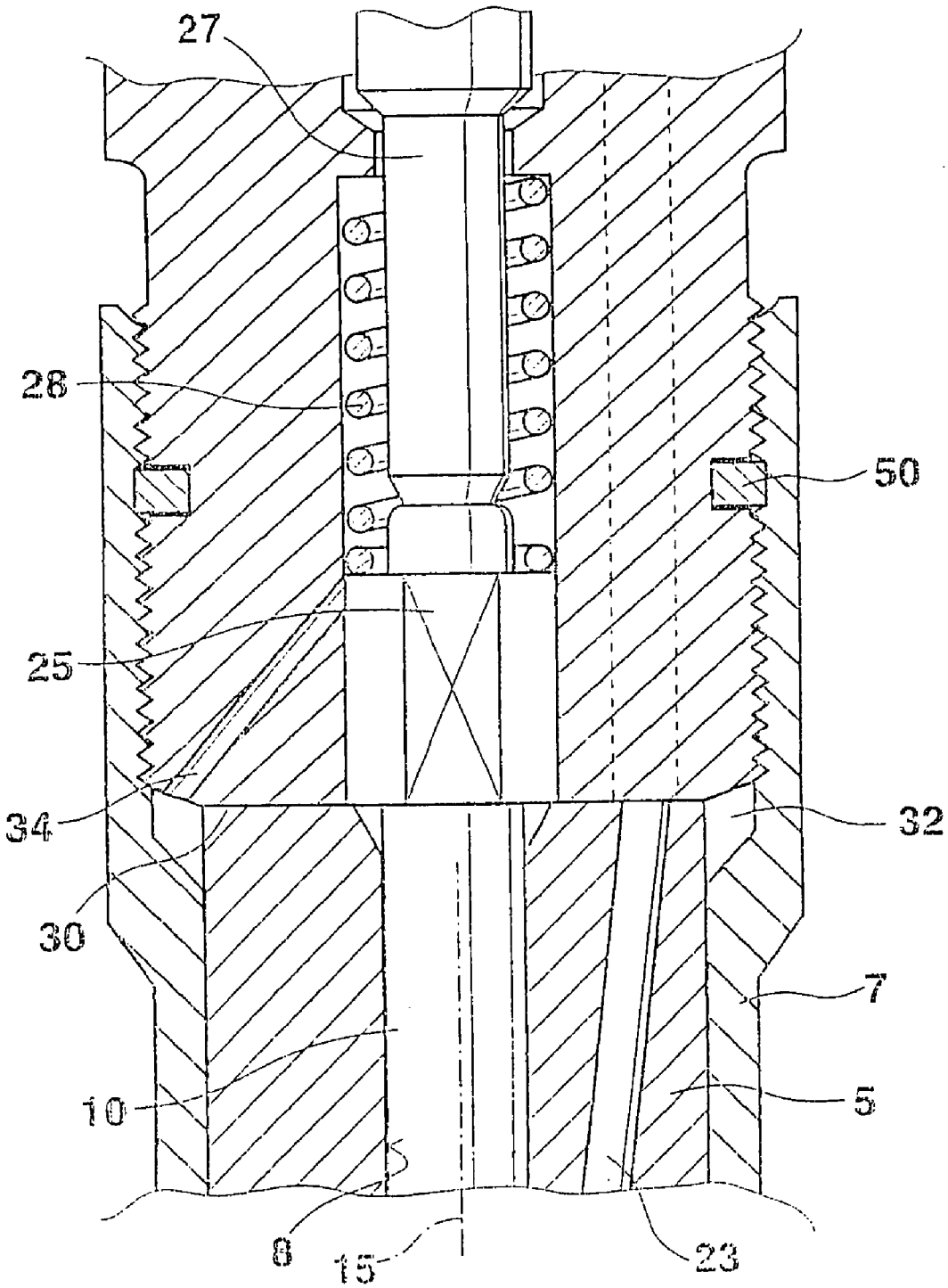
FIG. 4 is an enlargement of FIG. 1 in the region of the contact face of a further exemplary embodiment.

FIG. 4 shows a further exemplary embodiment of the fuel injection valve of the invention, in a detail in the region of the contact face 30. The connecting conduit 34 here is not embodied as a groove in one face end of the valve holding body 3 but rather as a bore in the valve holding body 3, which forms an angle of 45°, for instance, with the longitudinal axis 15. The connecting conduit 34 can begin at any point of the leak fuel chamber here, so that the remaining functional elements are unimpeded.

In the drawing, only two high-pressure bodies are shown, namely the valve holding body 3 and the valve body 5. However, it can also be provided that between these two bodies, still other high-pressure bodies are disposed, for instance in the form of shims. Then a plurality of contact faces can be embodied, which are all surrounded by the lock nut 7, so that the fuel emerging from the contact faces is removed without escaping to the outside from the fuel injection valve.

In addition to the disposition of a leak fuel chamber of the invention on a fuel injection valve, provision can also be made to use a wall part on any other high-pressure fuel system, in which a high-pressure chamber with fuel under pressure passes through the contact face between two high-pressure bodies. In this case as well, the leak fuel chamber can communicate with a suitable leak fuel system.

The foregoing relates to preferred exemplary embodiments of the invention, it being understood that other variants and embodiments thereof are possible within the spirit and scope of the invention, the latter being defined by the appended claims.

We claim:

1. A high-pressure fuel system, comprising a housing (1) that includes a first high-pressure body (3) and a second high-pressure body (5), which contact one another at a contact face (30)

a high-pressure chamber (23) embodied in the housing (1) and extending through the contact face (30), in which chamber a high fuel pressure exists at least intermittently, a sleevelike wall part (7) having an outer jacket face and a longitudinal axis (15), the wall part (7) surrounding the housing (1) at least in the region of the contact face (30) on the outer jacket face, and a leak fuel chamber (32) formed between the wall part (7) and the housing (1), the leak fuel chamber (32) being sealed off from the outside, further comprising two sealing connections embodied between the wall part (7) and the housing (1), one of said sealing connections being formed between the wall part (7) and the first high-pressure body (3), and the other said sealing connection formed between the wall part (7) and the second high-pressure body (5), wherein the wall part (7) is a lock nut which engages a thread (36) embodied on the housing (1) and thus presses the two high-pressure bodies (3, 5) against one another, and wherein at least one sealing connection of the wall part (7) and the housing (1) is formed by a sealing ring (50) disposed between the housing (1) and the wall part (7), and wherein the sealing ring (50) is positioned within an annular groove (52), which annular groove is disposed within the male thread (36).

2. The high-pressure fuel system of claim 1, further comprising a low-pressure chamber in the housing (1) and communicating with the leak fuel chamber (32), a markedly lower pressure prevailing in the low pressure chamber than in the high-pressure chamber (23).

3. The high-pressure fuel system of claim 1, wherein one of the sealing connections of the wall part (7) and the housing (1) is formed by the contact of a sealing face (42), embodied on the wall part (7), and a contact face (44), embodied on the housing (1).

4. The high-pressure fuel system of claim 1, wherein the sealing ring (50) comprises an elastically deformable material, preferably a plastic or an elastomer.

5. The high-pressure fuel system of claim 4, wherein the sealing ring (50) comprises polytetrafluoroethylene or a plastic containing polytetrafluoroethylene.

6. The high-pressure fuel system of claim 1, wherein the high-pressure fuel system is embodied as a fuel injection valve for an internal combustion engine.

* * * * *